United States Patent [19]

Fiske, II

[11] Patent Number: 4,585,160

[45] Date of Patent: Apr. 29, 1986

[54] NEGOTIABLE INSTRUMENT MAILING DEVICE

[76] Inventor: William W. Fiske, II, 2038 Old Gulph Rd., Villanova, Pa. 19085-1822

[21] Appl. No.: 728,425

[22] Filed: Apr. 29, 1985

[51] Int. Cl.[4] ..... B65D 27/04; B65D 27/06

[52] U.S. Cl. ..... 229/92.3; 283/58

[58] Field of Search ..... 229/92.3; 283/58

[56] References Cited

U.S. PATENT DOCUMENTS

| | | | |
|---|---|---|---|
| 1,424,837 | 8/1922 | Lover . | |
| 1,946,751 | 2/1934 | McCarthy . | |
| 2,302,455 | 11/1942 | Mattson | 229/92.3 |
| 2,396,221 | 3/1946 | Yancey . | |
| 2,831,707 | 4/1958 | James, Jr. et al. . | |
| 2,887,326 | 5/1959 | Kramer . | |
| 2,950,045 | 8/1960 | Martin | 229/92.3 |
| 2,984,403 | 5/1961 | David . | |
| 2,985,464 | 5/1961 | McFarland | 229/92.3 |
| 3,075,791 | 1/1963 | Wolf . | |
| 3,124,300 | 3/1964 | Vonderscher . | |
| 3,255,952 | 6/1966 | Black . | |
| 3,360,184 | 12/1967 | Greason . | |
| 3,672,703 | 6/1972 | Jay . | |
| 3,790,193 | 2/1974 | McBride . | |
| 3,791,572 | 2/1974 | Gendron . | |
| 3,837,565 | 9/1974 | Johnsen . | |
| 3,863,835 | 2/1975 | Gendron . | |
| 3,874,582 | 4/1975 | Wang . | |
| 3,937,492 | 2/1976 | Biron | 229/92.3 |
| 4,305,506 | 12/1981 | Greenwald . | |
| 4,308,987 | 1/1982 | Solomon . | |
| 4,332,346 | 6/1982 | Kronman . | |
| 4,334,618 | 6/1982 | Buescher . | |
| 4,335,845 | 6/1982 | Dierks . | |
| 4,354,631 | 10/1982 | Stevenson . | |
| 4,382,539 | 5/1983 | Kronman . | |
| 4,405,157 | 9/1983 | Bennett . | |
| 4,487,360 | 12/1984 | Fisher . | |

*Primary Examiner*—Stephen P. Garbe

*Attorney, Agent, or Firm*—Panitch Schwarze Jacobs & Nadel

[57] ABSTRACT

A negotiable instrument mailing device is formed from a single, generally continuous blank of paper or the like. The blank includes an addressee panel, a return address panel and a negotiable instrument panel. The negotiable instrument panel is imprinted with normal negotiable instrument indicia. The addressee panel is imprinted with the address of the addressee and includes a window opening. The return address panel is imprinted with the return address at a location so that when the return address panel is folded relative to the addressee panel, the return address is in registry with the window opening. Adhesive means are provided for securing the return address panel to the addressee panel when folded to form a generally sealed return envelope.

7 Claims, 5 Drawing Figures

NEGOTIABLE INSTRUMENT MAILING DEVICE

BACKGROUND OF THE INVENTION

The present invention relates generally to a device for mailing a negotiable instrument and, more particularly, to such a device which is formed from a single, generally continuous blank of paper or the like, and which may be formed into a sealed return envelope.

Many financial institutions, such as banks and trust companies, administer and invest funds of other entities and individuals. As part of the administration and investment of the funds, the banks and other financial institutions must periodically forward funds in the nature of investment income, interest, dividends or the like to the entities or individuals. In some cases, the financial institutions are required to forward the income on a monthly basis. In other cases, the income may be forwarded quarterly, semi-annually, or even annually.

The present invention comprises a mailing device which is convenient for forwarding income or other funds. The mailer includes a negotiable instrument or check portion which may be separated from the remainder of the device and negotiated in the normal manner. The remainder of the form comprises two attached panels which, when folded, form a sealed envelope. One of the panels is imprinted with the return address of the bank or other financial institution. Once the check portion has been removed, the remainder of the device can be conveniently used for transmitting instructions to the financial institution. For example, the recipient of the check may wish to have the financial institution change the address to which the income is sent, or the period of time for which the income should be accumulated prior to being sent. The present invention is formed from a single, generally continuous blank of paper and is adapted to be easily imprinted with the necessary information in a minimum amount of time.

SUMMARY OF THE INVENTION

Briefly stated, the present invention comprises a negotiable instrument mailing device which is formed from a single, generally continuous blank of paper or the like, and which includes a return envelope. The device is comprised of an addressee panel which includes two transversely extending edges and two side edges. A first surface of the addressee panel has a space for the insertion of the address of the addressee. The addressee panel also includes a window opening. The device further includes a return address panel which also includes two transversely extending edges and two side edges. A first one of the transversely extending edges of the return address panel is attached to a first one of the transversely extending edges of the addressee panel, along a common fold line. A first surface of the return address panel is imprinted with a return address, the return address being positioned so that when the two panels are folded along their common fold line with their first surfaces enclosed, the return address is in registry with the addressee panel window opening so the return address is visible.

The device also includes a negotiable instrument panel, also having two transversely extending edges and two side edges. One of the transversely extending edges of the negotiable instrument panel is removably attached to the second transversely extending edge of one of the addressee panel or the return address panel along a common tear line of perforations. A first surface of the negotiable instrument panel is imprinted with normal negotiable instrument indicia. Adhesive means are provided for securing the addressee panel to the return address panel when the panels are folded along their common fold line. In use, the negotiable instrument panel and the return address panel may be folded behind the addressee panel and the entire device may be inserted into a window envelope for delivery to the addressee. After delivery to the addressee, the negotiable instrument panel may be removed and information may be imprinted on either the return address panel or the addressee panel. The return address panel may then be folded with respect to the addressee panel along their common fold line and secured by the adhesive means to form the return envelope. Preferably, the negotiable instrument is a check and all three of the panels are generally rectangular with the same general dimensions.

BRIEF DESCRIPTION OF THE DRAWINGS

The foregoing summary, as well as the following detailed description, will be better understood when read in conjunction with the appended drawing. For the purpose of illustrating the invention, there is shown in the drawing embodiments which are presently preferred, it being understood, however, that this invention is not limited to the precise arrangements and instrumentalities shown. In the drawing.

DESCRIPTION OF PREFERRED EMBODIMENT

Figure 2:
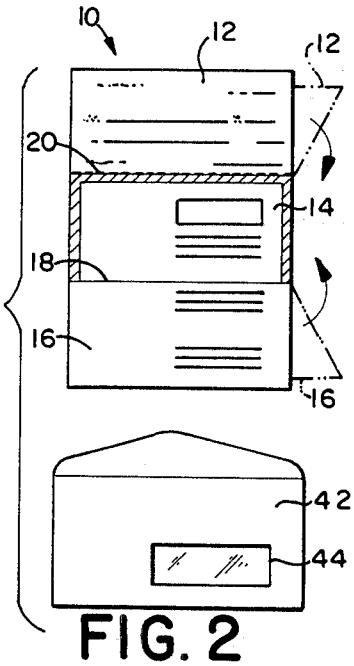
FIG. 2 is a reduced size plan view of the device of FIG. 1, partially in phantom to show how the device is folded.
Figure 1:
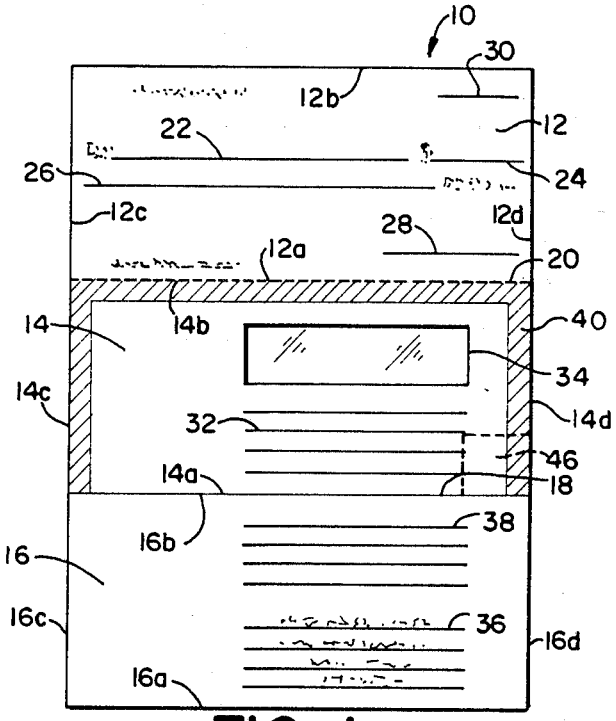
FIG. 1 is a top plan view of a negotiable instrument mailing device in accordance with the present invention.

Referring in detail to the drawing, and particularly to FIG. 1, there is shown a negotiable instrument mailing device 10 in accordance with the present invention. The device 10 is comprised of a negotiable instrument panel 12, an addressee panel 14 and a return address panel 16 which are formed from a single, generally continuous blank of paper or the like. In the present embodiment, each of the panels 12, 14 and 16 is generally rectangular, and the panels all have the same general overall dimensions. However, it should be understood that the panels 12, 14 and 16 may be of any other convenient shape, such as square. Likewise, the panels 12, 14 and 16 may differ from each other in size, if desired.

Each of the panels 12, 14 and 16 includes two transversely extending edges **12*a* and 12*b*, 14*a* and 14*b*, and 16*a* and 16*b*, respectively, and two side edges 12*c* and 12*d*, 14*c* and 14*d*, and 16*c* and 16*d*, respectively. A first transversely extending edge of the return address panel 16 is attached to a first transversely extending edge of the address panel 14 along a common fold line 18. In the present embodiment, the top edge 16*b* of the return address panel 16 is attached to the bottom edge 14*a* of the addressee panel 14. However, it will be appreciated by those skilled in the art that the two panels 14 and 16 could be attached in the opposite manner, i.e., the top edge 14***b* of the addressee panel 14 could be attached to the bottom edge 16*a* of the return address panel 16 (not shown).

Similarly, one of the transversely extending edges of the negotiable instrument panel 12 is removably attached to the second transversely extending edge of either the addressee panel 14 or the return address panel 16 along a common tear line of perforations 20. In the present embodiment, the bottom edge 12*a* of the negotiable instrument panel is attached to the top edge 14*b* of the addressee panel 14. However, it will be appreciated by those skilled in the art that the negotiable instrument panel 12 could be attached to either of the other two panels 14 or 16 in any other manner. For example, the top edge 12*b* of the negotiable instrument panel 12 could be attached to the bottom edge 16*a* of the return address panel 16.

The mailing device 10 and each of the individual panels 12, 14 and 16 has a first or front surface (shown in FIG. 1) and a second or back surface (not shown). The front or first surface of the negotiable instrument panel 12 is imprinted with normal negotiable instrument indicia. In the present embodiment, the negotiable instrument is a check which is imprinted with indicia, including a blank space for identifying the payee 22, blank spaces for setting forth the amount of the check both in numerals 24, and in letters 26, a blank space for indicating the date of the check 28, and a blank space for the signature of the maker 30. Other typical check indicia, such as the account number data, the name of the financial institution, the number of the check, etc. may also be imprinted on the front surface of the check panel. The back surface of the check panel 12 (not shown) may be blank or may contain endorsement information, instructions or other information of the type typically applied to the back panel of any other check.

The front surface of the addressee panel 14 includes a blank space 32 within which may be inserted the address of the addressee. The addressee space 32 is located near the lower center of the addressee panel 14 so that when the mailing device 10 is placed within a window envelope in the manner which will hereinafter be described, the addressee space 32 is in registry with the window opening of the envelope so that the address of the addressee is clearly visible. The addressee panel 14 also includes a window opening 34 extending therethrough. In the present embodiment, the window opening 34 is generally rectangular and is positioned adjacent to the addressee space 32. In addition, in the present embodiment, the window opening 34 is shown as being covered by a transparent material of the type normally employed in window envelopes. It should be understood that the size, shape and location of the window opening 34 may be different from that shown in the preferred embodiment. Likewise, if desired, the window opening 34 need not have a transparent cover.

The front surface of the return address panel 16 includes a space 36 within which, in the present embodiment, is imprinted the return address. The return address which is imprinted within the space 36 may be that of a particular individual or facility within the financial institution, or may be that of a particular processing facility. As will hereinafter become apparent, the return address space 36 is positioned on the return address panel 16 so that when the return address panel 16 and the addressee panel 14 are folded together along fold line 18 with their respective front surfaces facing each other, the return address imprinted within the return address space 36 is in registry with the addressee panel window opening 34 to enable the return address to be clearly visible through the addressee panel window opening 34.

The front surface of the return address panel also includes a space 38 for use by the addressee or recipient of the check to enter information for return to the financial institution, outside processing agency, or the like. As discussed above, the information which may be conveyed could be, for example, a change of address of the addressee, a change of instructions with regard to the amount of the check or any other such pertinent information. In the present embodiment, the information space 38 is located adjacent to the return address space 36. However, it will be appreciated by those skilled in the art that information could be entered at any other convenient location upon the return address panel 16. Likewise, information could be entered at any convenient location on the addressee panel 14, if desired. Therefore, the present invention is not limited to the information being entered only within the particular information space 38 as shown.

Adhesive means are provided for securing the addressee panel 14 to the return address panel 16 when the two panels 14 and 16 are folded along fold line 18. In the present embodiment, the adhesive means comprises a generally continuous strip of adhesive material 40 which extends along the side edges 14*c* and 14*d* and the top edge 14*b* of the addressee panel 14. The adhesive strip may be of the type which must be moistened to provide adhesion, or may be of any other type, such as the rubber cement type, which does not require the addition of moisture to provide adhesion. Although, in the present embodiment, the adhesive strip is shown as being secured to the addressee panel, the adhesive strip could alternatively be placed on the return address panel 16. In addition, although in the presently preferred embodiment, the adhesive strip 40 extends along three edges of the addressee panel 14, alternatively, the adhesive strip 40 could extend along a lesser number of edges, for example, only the top edge 14*b*.

In using the mailing device 10, information, including the name of the payee, the amount of the check, etc. is imprinted on the check panel 12 in the normal manner. The address of the addressee or payee is inserted into the addressee space 32 on the addressee panel 14 and, if the return address is not already printed on the return address panel 16, the return address is placed within the return address space 36. The mailer 10 is now ready for mailing. The check panel 12 is folded along the tear line 20 so that the back surface of the check panel 12 engages the back surface of the addressee panel 14. Similarly, the return address panel 16 is folded along fold line 18 so that the back surface of the return address panel 16 engages the front surface of the folded check panel 12 to enclose and protect the check panel 12. The folded mailer 10 is then inserted into a window envelope 42 so that the addresse space 32 of the addressee panel 14 is in registry with the window opening 44 of the envelope 42. The envelope 42 containing the mailer 10 is then mailed or otherwise conveyed to the addressee.

Figure 3:
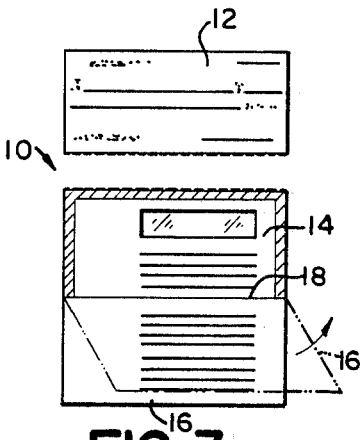
FIG. 3 is a reduced size plan view of the device of FIG. 1 with the negotiable instrument panel separated from the remainder of the device.

When the addressee receives the envelope 42, the mailer 10 is removed and the check panel 12 is separated as shown in FIG. 3. The check may then be cashed or otherwise negotiated in the normal manner.

Figure 4:
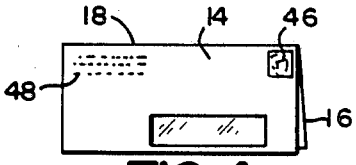
FIG. 4 is a reduced size plan view of the return envelope formed from a portion of the device of FIG. 1.

If the recipient wishes to convey information to the financial institution, the recipient may write the information within the information space 38 or at any other convenient location on the front surface of the addressee panel 14 or the return address panel 16. Thereafter, the return address panel 16 and the addressee panel 14 are folded along fold line 18 so that their front surfaces face and engage each other as shown in FIG. 4. As previously discussed, when the two panels 14 and 16 are so folded, the return address imprinted within return address space 36 is visible through window opening 34 as shown in FIG. 4. The adhesive strip 40 is moistened, if necessary, and the two panels 14 and 16 are secured together to form an envelope which is generally sealed on all four edges.

The back surface of the addressee panel 14 includes a space 46 for postage and a space 48 for inserting the return address of the addressee. The postage space 46 may contain a message, such as "Place Postage Here". Alternatively, the bank or other financial institution may wish to supply postage, either in the form of a stamp, a business reply permit number, or the like.

Figure 5:
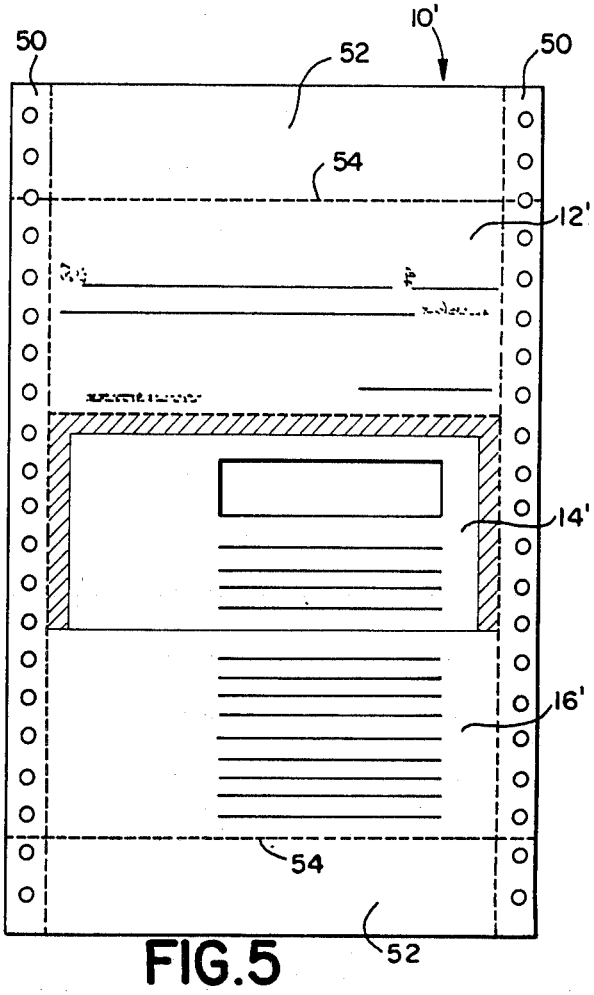
FIG. 5 is a plan view of an alternate embodiment of the invention which may be employed in conjunction with a printer apparatus.

FIG. 5 shows an alternate embodiment of the present invention which is particularly adapted for use in a printer (not shown), particularly a computer controlled printer. In the embodiment shown in FIG. 5, the mailing device 10' comprises panels 12' 14' and 16' which are substantially the same as the corresponding panels of the embodiment shown in FIGS. 1 through 4. However, in the alternate embodiment shown in FIG. 5, the side edges of the panels 12', 14' and 16' are secured to removable strips 50 having a plurality of perforations adapted to engage the pins (not shown) of a pin-wheel type printer (not shown). In this manner, a plurality of mailers 10' can be provided on a continuously feeding strip of paper (not shown). Blank panels 52 may be employed to separate the individual mailers 10' from one another. The blank panels 52 are removably secured to the tops and bottoms of the mailers along perforated lines 54. Alternatively, the blank panels 52 may be eliminated and the bottom edge of the return address panel 16' may be joined to the top edge of the next check panel (not shown) along perforated line 54.

From the foregoing description, it can be seen that the present invention comprises a negotiable instrument mailing device which may be employed for prompt and convenient transmission of a negotiable instrument or check. The mailing device may also be formed into a preaddressed return envelope for conveying information from the recipient. It will be recognized by those skilled in the art that changes may be made to the above-described embodiments without departing from the broad inventive concepts thereof. It is understood, therefore, that this invention is not limited to the particular embodiments disclosed, but it is intended to cover any modifications which are within the scope and spirit of the invention as defined by the appended claims.

I claim:

1. A negotiable instrument mailing device including a return envelope formed from a single generally continuous blank of paper or the like, comprising:

an addressee panel, including two transversely extending edges and two side edges, a first surface of the addressee panel having a space for the insertion of the address of the addressee, the addressee panel also including a window opening;

a return address panel, including two transversely extending edges and two side edges, a first one of the transversely extending edges of the return address panel being attached to a first one of the transversely extending edges of the addressee panel along a common fold line, a first surface of the return address panel being imprinted with a return address, the return address panel and the addressee panel being adapted to be folded along their common fold line so that their first surfaces are enclosed, the return address being positioned on the return address panel to be in registry with the addressee panel window opening when the panels are so folded so the return address is visible through the addressee panel window opening;

a negotiable instrument panel including two transversely extending edges and two side edges, one of the transversely extending edges of the negotiable instrument panel being removably attached to the second transversely extending edge of one of the addressee panel or the return address panel along a common tear line of perforations, a first surface of the negotiable instrument panel being imprinted with normal negotiable instrument indicia; and adhesive means for securing the addressee panel to the return address panel when folded along their common fold line, whereby the negotiable instrument panel and the return address panel may be folded behind the addressee panel and the device may be inserted into a window envelope so that the address on the addressee panel is visible through the envelope window for delivery to the addressee and, after delivery to the addressee, the negotiable instrument panel may be removed and information may be imprinted on either the return address panel or the addressee panel and the return address panel may be folded with respect to the addressee panel along their common fold line and secured by the adhesive means to form the return envelope.

2. The device as recited in claim 1 wherein the negotiable instrument is a check, the check panel, the addressee panel, and the return address panel being generally rectangular and having the same general dimensions.

3. The device as recited in claim 2 wherein the second surface of the addressee panel includes a postage area.

4. The device as recited in claim 3 wherein the adhesive means is located on the first surface of the addressee panel.

5. The device as recited in claim 4 wherein the adhesive means comprises an elongated strip of adhesive which extends along the second transversely extending edge of the address panel.

6. The device as recited in claim 5 wherein the adhesive means further comprises a pair of adhesive strips extending along the side edges of the addressee panel.

7. The device as recited in claim 5 wherein the first surface of the return address panel includes a space for the insertion of a change of address of the addressee.

* * * * *